US008571447B2

(12) United States Patent
Eto

(10) Patent No.: US 8,571,447 B2
(45) Date of Patent: Oct. 29, 2013

(54) SHUTTER OPENING/CLOSING MECHANISM AND IMAGE FORMING APPARATUS PROVIDED WITH THE SAME

(75) Inventor: Daisuke Eto, Osaka (JP)

(73) Assignee: Kyocera Mita Corporation (JP)

( * ) Notice: Subject to any disclaimer, the term of this patent is extended or adjusted under 35 U.S.C. 154(b) by 248 days.

(21) Appl. No.: 12/975,811

(22) Filed: Dec. 22, 2010

(65) Prior Publication Data

US 2011/0188895 A1 Aug. 4, 2011

(30) Foreign Application Priority Data

Jan. 29, 2010 (JP) ..... 2010-017722

(51) Int. Cl.
*G03G 15/08* (2006.01)

(52) U.S. Cl.
USPC ..... 399/260

(58) Field of Classification Search
USPC ..... 399/260, 223, 231
See application file for complete search history.

(56) References Cited

U.S. PATENT DOCUMENTS 8,244,155 B2 * 8/2012 Kouda ..... 399/119
2008/0056759 A1 * 3/2008 Koido ..... 399/106

FOREIGN PATENT DOCUMENTS

JP 2008191578 A * 8/2008
JP 2009-116306 5/2009
JP 2009116306 A * 5/2009

OTHER PUBLICATIONS

Translation of JP2009-116306A, May 28, 2009, to Mukai et al.*

* cited by examiner

*Primary Examiner* — Quana M Grainger

(74) *Attorney, Agent, or Firm* — Gerald E. Hespos; Michael J. Porco; Matthew T. Hespos

(57) ABSTRACT

A joint member moves forward and backward between an advanced position and a retracted position according to the rotation of a rotary member when a cover is opened and closed between an open state and a half open state, and rotates at the advanced position according to the rotation of the rotary member when the cover is opened and closed between the half open state and a closed state. A coupling member is engaged with the joint member when the joint member is at the advanced position while being disengaged from the joint member when the joint member is at the retracted position. The coupling member opens and closes a toner supply port by rotating according to the rotation of the joint member engaged therewith at the advanced position.

10 Claims, 12 Drawing Sheets

SHUTTER OPENING/CLOSING MECHANISM AND IMAGE FORMING APPARATUS PROVIDED WITH THE SAME

BACKGROUND OF THE INVENTION

1. Field of the Invention

This disclosure relates to a shutter opening/closing mechanism for opening and closing a toner supply port of a toner container as a cover of an image forming apparatus main body is closed and opened, and an image forming apparatus provided with the same.

2. Description of the Related Art

In an image forming apparatus such as a copier or a printer for electrophotographically forming an image on a sheet, an amount of toner corresponding to a consumed amount is supplied from a toner container to a developing device when toner in the developing device is consumed in the case of adopting the developing device using a two-component developer. The toner container is mounted and detached by opening a cover of an image forming apparatus main body and inserting or withdrawing the toner container into or from the image forming apparatus main body. The toner container is provided with a container shutter for opening and closing the toner supply port to prevent the toner from scattering around when the toner container is mounted or detached. The toner supply port is closed by the container shutter when the toner container is mounted and detached. When the toner container is mounted into the image forming apparatus main body, the toner container is moved to open the toner supply port, thereby enabling toner supply.

A shutter opening/closing mechanism for linking opening and closing movements of a toner supply port by a container shutter with closing and opening movements of a cover of an image forming apparatus main body is known in conventional image forming apparatuses. The shutter opening/closing mechanism includes a joint member to be connected to a coupling member of the container shutter, a rotary member (main body joint gear) for holding the joint member, and a spring for biasing the joint member toward the container shutter. In the shutter opening/closing mechanism, the main body joint gear is rotated as the cover is opened and closed, with the result that the joint member rotates. When the joint member rotates, the coupling member rotates to move the container shutter, whereby the toner supply port is opened or closed.

With such a shutter opening/closing mechanism, upon mounting the toner container at a predetermined position in the image forming apparatus main body, the toner container is inserted to the predetermined position with the joint member temporarily retracted toward a side opposite to a biasing direction by the spring. When the toner container is inserted to the predetermined position, the coupling member and the joint member are arranged to face in the biasing direction, wherefore the joint member moves forward in the biasing direction to be connected to the coupling member.

In the conventional shutter opening/closing mechanism as described above, for example, the toner container is inserted to the predetermined position with the joint member held in contact with a chamfer (inclined surface) formed on the coupling member, whereby the joint member is pushed by the inclined surface and temporarily retracted to the side opposite to the biasing direction. However, in the case of a structure in which the joint member is pushed and retracted by the inclined surface of the coupling member as described above, resistance may increase when the toner container is inserted.

Upon pulling out the toner container at the predetermined position, the toner container cannot be pulled out straight since the joint member is connected to the coupling member. Thus, it has been necessary to obliquely pull the toner container out while slightly rotating the toner container about the coupling member.

SUMMARY OF THE INVENTION

An object of the present invention is to provide a shutter opening/closing mechanism which enables a toner container to be smoothly mounted and detached and an image forming apparatus provided with the same.

The present invention relates to a shutter opening/closing mechanism for opening and closing a toner supply port of a toner container as a cover of an image forming apparatus main body is closed and opened. The shutter opening/closing mechanism includes a rotary member, a joint member and a coupling member.

The rotary member is provided in the image forming apparatus main body and rotates in one rotating direction as the cover is opened while rotating in another rotating direction as the cover is closed.

The joint member is movable forward and backward in an advancing direction and a retracting direction between an advanced position and a retracted position along a direction of a rotation axis of the joint member with the rotation of the rotary member when the cover is opened and closed between an open state where the cover is open and a half open state reached by moving the cover in a closing direction from the open state, and rotatable at the advanced position with the rotation of the rotary member when the cover is opened and closed between the half open state and a closed state where the cover is closed.

The coupling member is rotatably provided in the toner container, and engaged with the joint member when the joint member is at the advanced position while being disengaged from the joint member when the joint member is at the retracted position. The coupling member is capable of opening and closing the toner supply port by rotating with the rotation of the joint member engaged therewith at the advanced position.

DETAILED DESCRIPTION OF THE PREFERRED EMBODIMENTS

Hereinafter, a shutter opening/closing mechanism and an image forming apparatus provided with the same according to one embodiment of the present invention are described in detail with reference to the drawings.

[Image Forming Apparatus]

Figure 1:
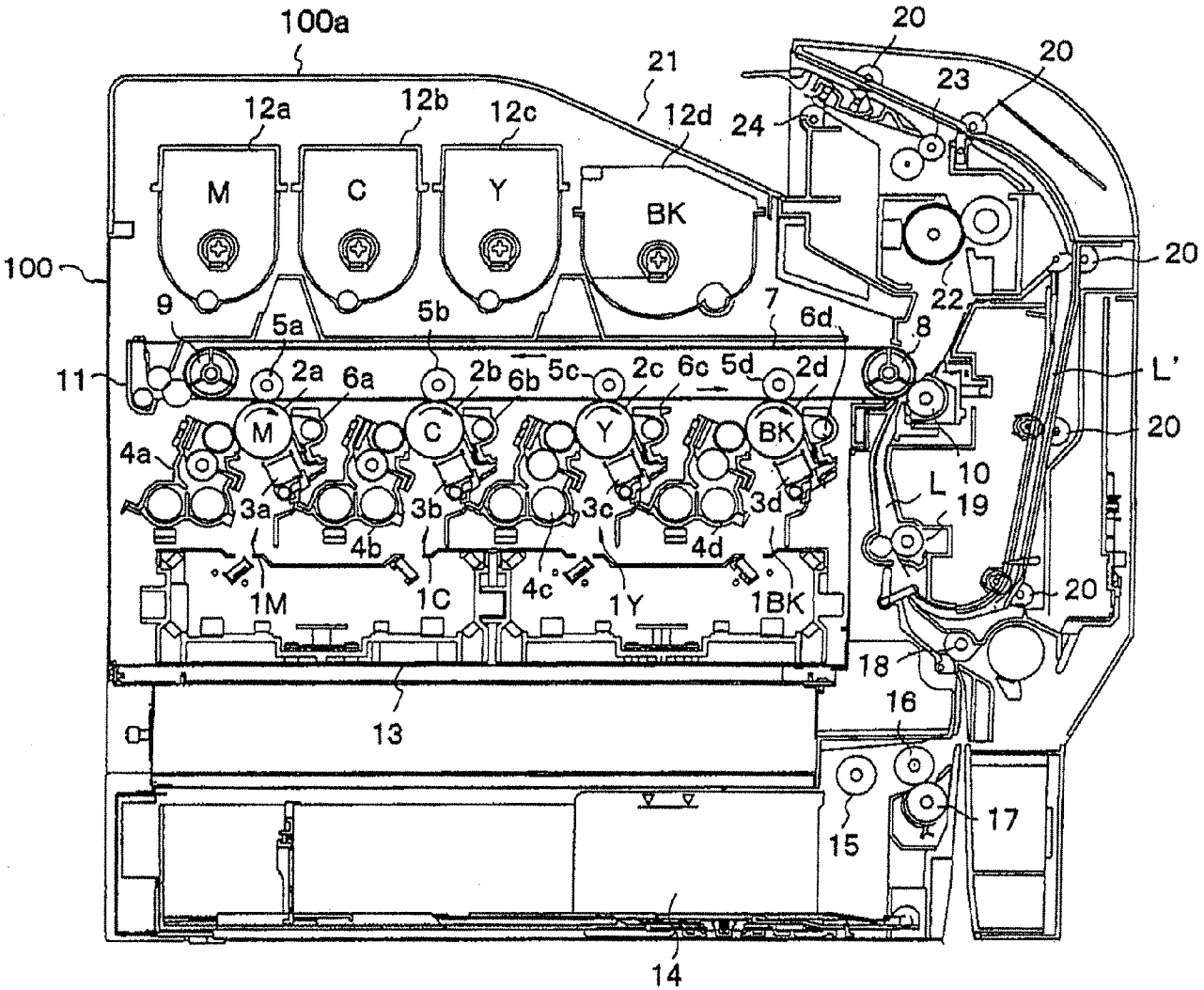
FIG. 1 is a sectional view showing an image forming apparatus according to one embodiment of the invention.

As shown in FIG. 1, the image forming apparatus of this embodiment is provided with an image forming apparatus main body 100 and toner containers 12 (12*a*, 12*b*, 12*c*, 12*d*) detachably mountable into the image forming apparatus main body 100. The image forming apparatus is of the tandem type. A magenta image forming unit 1M, a cyan image forming unit 1C, a yellow image forming unit 1Y and a black image forming unit 1BK are arranged at specified intervals in a central part of the interior of the image forming apparatus main body 100.

Photoconductive drums 2*a*, 2*b*, 2*c* and 2*d* as image bearing members are respectively arranged in the corresponding image forming units 1M, 1C, 1Y and 1BK. Chargers 3*a*, 3*b*, 3*c* and 3*d*, developing devices 4*a*, 4*b*, 4*c* and 4*d*, transfer rollers 5*a*, 5*b*, 5*c* and 5*d* as transfer devices and drum cleaners 6*a*, 6*b*, 6*c* and 6*d* are respectively arranged around the corresponding photoconductive drums 2*a* to 2*d*.

The photoconductive drums 2*a* to 2*d* are drum-shaped photoconductors and rotated at a predetermined processing speed in shown arrow directions (clockwise directions) by unillustrated motors. Further, the chargers 3*a* to 3*d* uniformly charge surfaces of the photoconductive drums 2*a* to 2*d* at predetermined potentials by charging biases applied from unillustrated charging bias supplies, respectively.

The developing devices 4*a* to 4*d* contain two-component developers respectively including magenta (M) toner, cyan (C) toner, yellow (Y) toner and black (BK) toner. The developing devices 4*a* to 4*d* develop electrostatic latent images into visible toner images of the respective colors by attaching the toners of the respective colors to the respective electrostatic latent images formed on the respective photoconductive drums 2*a* to 2*d*.

The transfer rollers 5*a* to 5*d* are so arranged as to be in contact with the respective photoconductive drums 2*a* to 2*d* via an intermediate transfer belt 7 in respective primary transfer portions. The intermediate transfer belt 7 is wound around a secondary transfer facing roller 8 and a tension roller 9 and arranged to run above the respective photoconductive drums 2*a* to 2*d*. The secondary transfer facing roller 8 is so arranged as to be in contact with a secondary transfer roller 10 via the intermediate transfer belt 7 in a secondary transfer portion. Further, a belt cleaner 11 is disposed near the tension roller 9. The intermediate transfer belt 7 may be made of, for example, dielectric resin such as polycarbonate, polyethylene terephthalate (PET) or polyvinylidene fluoride (PVDF).

The toner containers 12*a*, 12*b*, 12*c* and 12*d* for supplying toners to the respective developing devices 4*a* to 4*d* are arranged in a row above the respective image forming units 1M, 1C, 1Y and 1BK in the image forming apparatus main body 100.

Figure 2:
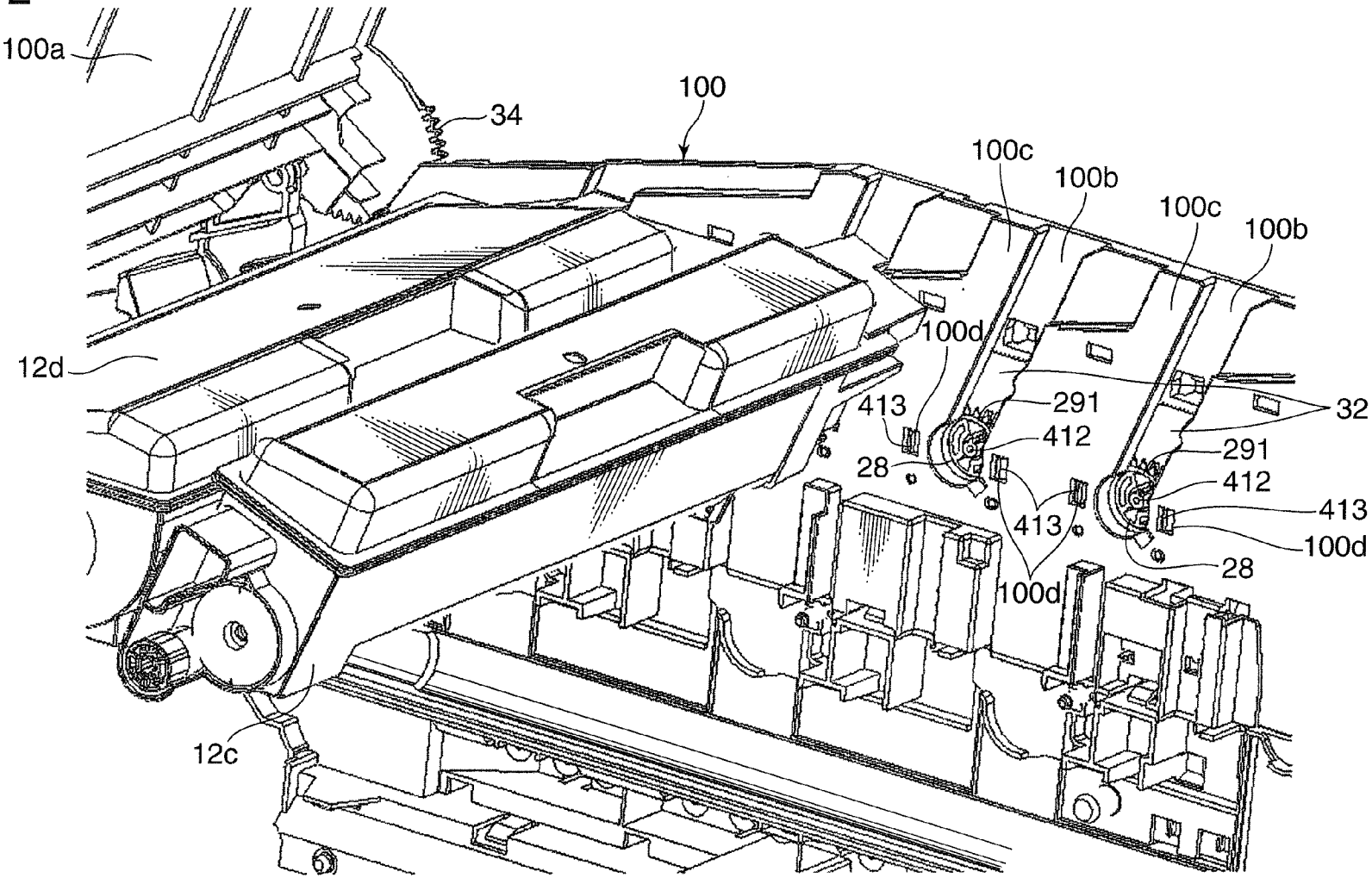
FIG. 2 is a partial perspective view showing an internal structure of the image forming apparatus.

As shown in FIG. 2, guide grooves 100*b* for guiding coupling members 27 (shown in FIG. 3) of the respective toner containers 12 are formed in a side plate 100*c* of the image forming apparatus main body 100. The respective toner containers 12 (12*a* to 12*d*) are inserted downward from an upper side to predetermined positions of the image forming apparatus main body 100 by opening a top cover 100*a* of the image forming apparatus main body 100 and sliding the respective coupling members 27 along the corresponding guide grooves 100*b*.

Laser scanner units (LSUs) 13 are arranged below the respective image forming units 1M, 1C, 1Y and 1BK in the image forming apparatus main body 100, and a sheet cassette 14 is detachably mounted in the image forming apparatus main body 100 in a bottom part of the image forming apparatus main body 100 below the laser scanner units 13. A plurality of unillustrated sheets are stacked and stored in the sheet cassette 14. A pickup roller 15 for picking up a sheet from the sheet cassette 14 and a feed roller 16 and a retard roller 17 for feeding the picked-up sheet to a conveyance path L are disposed near the sheet cassette 14.

A pair of conveyor rollers 18 for conveying a sheet and a pair of registration rollers 19 for supplying the sheet to the secondary transfer portion, where the secondary transfer facing roller 8 and the secondary transfer roller 10 are in contact, at a predetermined timing after keeping the sheet temporarily on standby are disposed in the conveyance path L vertically extending in a lateral part of the image forming apparatus main body 100. Another conveyance path L' used in the case of forming images on both sides of a sheet is formed lateral to the conveyance path L, and a plurality of pairs of conveyor rollers 20 are disposed at appropriate intervals in the conveyance path L'.

The conveyance path L vertically arranged in one lateral interior part of the image forming apparatus main body 100 extends up to a discharge tray 21 provided on the upper surface of the image forming apparatus main body 100, and a fixing device 22, a pair of discharge rollers 23 and a discharging device 24 are disposed along the conveyance path L.

Next, an image forming operation by the image forming apparatus with the above construction is described.

When an image formation start signal is issued, the respective photoconductive drums 2*a* to 2*d* are rotated at the specified processing speed in the arrow directions (clockwise directions) of FIG. 1 and uniformly charged by the chargers 3*a* to 3*d* in the respective image forming units 1M, 1C, 1Y and 1BK. The laser scanner unit 13 irradiates the surfaces of the respective photoconductive drums 2*a* to 2*d* with laser beams modulated by color image signals of the respective colors to form electrostatic latent images corresponding to the color image signals of the respective colors on the respective photoconductive drums 2*a* to 2*d*.

Then, the magenta toner is attached to the electrostatic latent image formed on the photoconductive drum 2*a* of the magenta image forming unit 1M by the developing device 4*a* having a developing bias with the same polarity as a charge polarity of the photoconductive drum 2*a* applied thereto. In this way, the electrostatic latent image is developed into a visible magenta toner image. This magenta toner image is primarily transferred to the intermediate transfer belt 7 rotated in an arrow direction of FIG. 1 by the action of the transfer roller 5*a* having a primary transfer bias with a polarity opposite to a charge polarity of the toner applied thereto in the primary transfer portion (transfer nip portion) between the photoconductive drum 2*a* and the transfer roller 5*a*.

The intermediate transfer belt 7 having the magenta toner image primarily transferred thereto in the above manner moves to the next cyan image forming unit 1C. Then, also in the cyan image forming unit 1C, a cyan toner image formed on the photoconductive drum 2*b* is transferred and superimposed on the magenta toner image on the intermediate transfer belt 7 in the primary transfer portion similar to the magenta image forming unit 1M.

Thereafter, similarly, yellow and black toner images respectively formed on the photoconductive drums 2*c*, 2*d* of the yellow and black image forming units 1Y and 1BK are successively superimposed on the magenta and cyan toner images transferred and superimposed on the intermediate transfer belt 7 in the respective primary transfer portions. In this way, a full color toner image is formed on the intermediate transfer belt 7. Note that the toners remaining on the respective photoconductive drums 2*a* to 2*d* without being transferred to the intermediate transfer belt 7 are removed by the respective drum cleaners 6*a* to 6*d*. Further, residual charges on the respective photoconductive drums 2*a* to 2*d* are removed by unillustrated charge neutralization devices, whereby the respective photoconductive drums 2*a* to 2*d* are prepared for the next image formation.

A sheet fed from the sheet cassette 14 to the conveyance path L by the pickup roller 15, the feed roller 16 and the retard roller is conveyed to the secondary transfer portion by the pair of registration rollers 19 at a timing at which the leading end of the full color toner image on the intermediate transfer belt 7 reaches the secondary transfer portion (transfer nip portion) between the secondary transfer facing roller 8 and the secondary transfer roller 10. Then, the full color toner image is secondarily transferred from the intermediate transfer belt 7 to the sheet conveyed to the secondary transfer portion by the action of the secondary transfer roller 10 having a secondary transfer bias with a polarity opposite to the charge polarity of the toner applied thereto.

The sheet having the full color toner image transferred thereto is conveyed to the fixing device 22 and the full color toner image is heated and pressed to be thermally fixed to a surface of the sheet. The sheet having the toner image fixed thereto is conveyed to the discharging device 24 by the pair of discharge rollers 23 and discharged onto the discharge tray 21 by the discharging device 24, whereby a series of image forming operations are completed. Note that the toner remaining on the intermediate transfer belt 7 without being transferred to the sheet is removed by the belt cleaner 11, so that the intermediate transfer belt 7 is prepared for the next image formation.

[Shutter Opening/Closing Mechanism]

Figure 3:
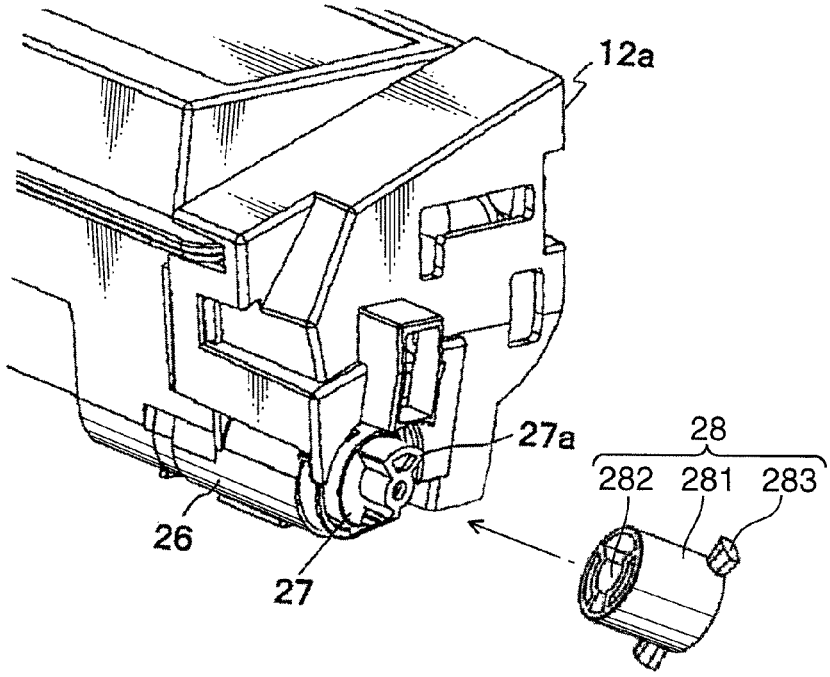
FIG. 3 is a partial perspective view showing a relationship between a coupling member and a joint member in the image forming apparatus.
Figure 5A:
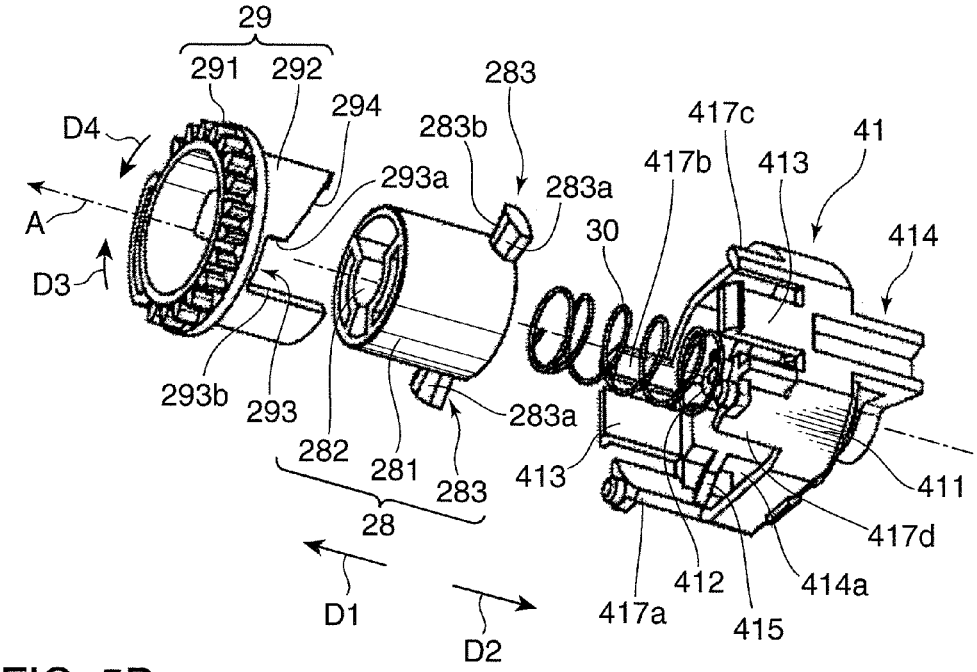
FIGS. 5A and 5B are perspective views showing an essential part of the shutter opening/closing mechanism in the image forming apparatus.
Figure 5B:
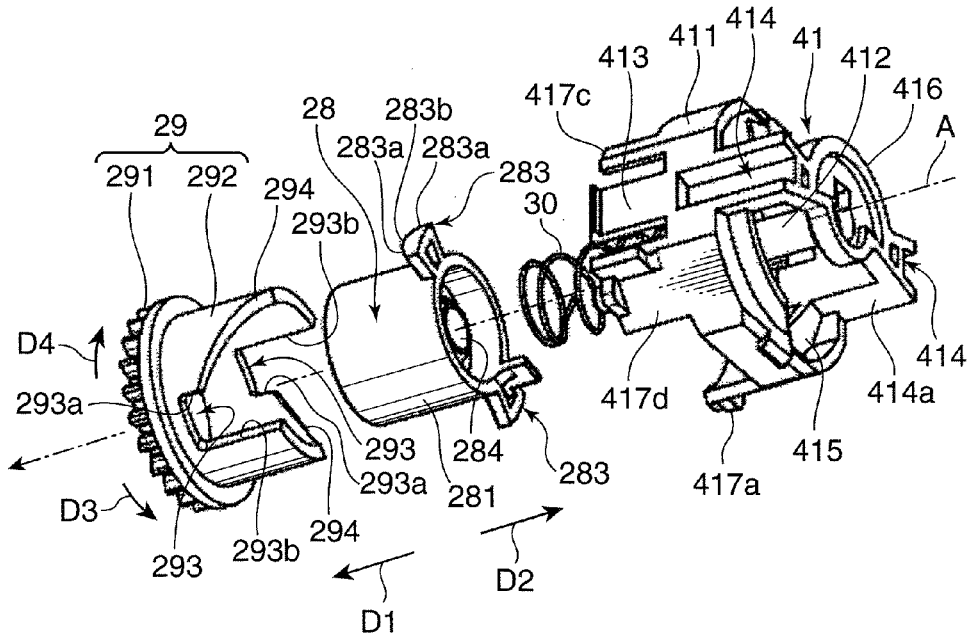

Next, the shutter opening/closing mechanism according to one embodiment of the present invention is described. As shown in FIGS. 3, 5A and 5B, the shutter opening/closing mechanism of this embodiment includes a coupling member 27, a joint member 28 and a rotary member 29. The coupling member 27 is provided in the toner container 12. The joint member 28 and the rotary member 29 are supported on a frame member 41 fixed to the image forming apparatus main body 100.

The shutter opening/closing mechanism is specifically described below. Since the toner containers 12*a* to 12*d* have the same basic construction, the shutter opening/closing mechanism in the magenta toner container 12*a* is described as a representative example.

Figure 4A:
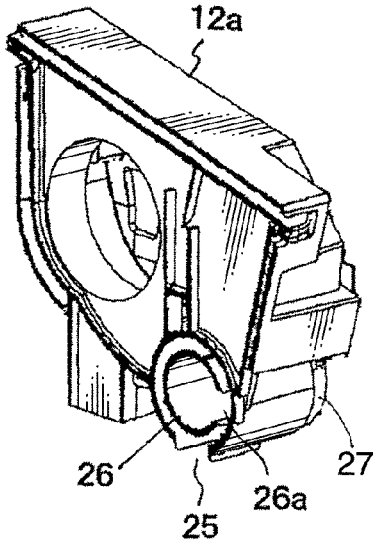
FIG. 4A is a partial perspective view showing a state where a toner supply port of a toner container is closed.
Figure 4B:
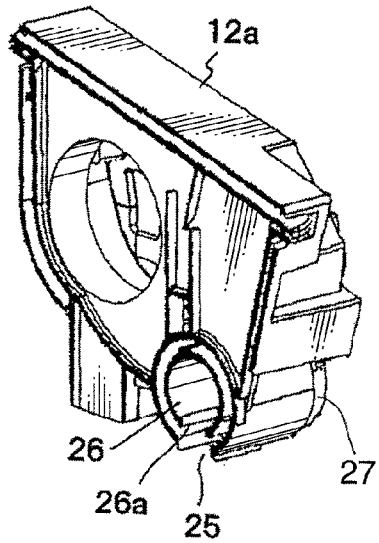
FIG. 4B is a partial perspective view showing a state where the toner supply port of the toner container is open.

As shown in FIGS. 3, 4A and 4B, the toner container 12*a* includes a rectangular toner supply port 25 in its bottom surface. The toner supply port 25 is opened and closed by a cylindrical container shutter 26. The container shutter 26 includes a rectangular hole 26 having the same shape as the toner supply port 25.

As shown in FIG. 4A, the toner supply port 25 is closed in a state where the rectangular hole 26*a* of the container shutter 26 is facing sideways and does not communicate with the toner supply port 25. As shown in FIG. 4B, the container shutter 26 is rotated so that the rectangular hole 26*a* communicates with the toner supply port 25, whereby the toner supply port 25 is opened.

As shown in FIG. 3, the coupling member 27 is fitted in an end portion of the container shutter 26. The coupling member 27 includes an engaging projection 27*a* projecting in a direction of a rotation axis of the container shutter 26. The engaging projection 27*a* is composed of a cylindrical part projecting along the rotation axis, a fan-shaped part radially projecting in a fan-like manner from the cylindrical part and a linear part radially and linearly projecting from the cylindrical part toward a side opposite to the fan-shaped part.

As shown in FIGS. 5A and 5B, the joint member 28 includes a cylindrical main portion 281, an engaging recess (engaging portion) 282 formed in one end of the cylindrical main portion 281 in a direction D1 (advancing direction) and engageable with the engaging projection 27*a* of the coupling member 27, and a pair of projections 283 provided at another end of the cylindrical main portion 281 in a direction D2 (retracting direction) and projecting radially outward from a side surface of the cylindrical main portion 281. The pair of projections 283 respectively extends from positions of the cylindrical main portion 281 facing each other in a radial direction.

The engaging recess 282 is shaped in conformity with the engaging projection 27*a* of the coupling member 27 so that the engaging projection 27*a* can be fitted. Specifically, the engaging recess 282 is composed of a cylindrical recess into which the cylindrical part of the engaging projection 27*a* is to be fitted, a fan-shaped recess which is formed to radially extend in a fan-like manner from the cylindrical recess and into which the fan-shaped part of the engaging projection 27*a* is to be fitted, and a linear recess which is formed to radially and linearly extend from the cylindrical recess toward a side opposite to the fan-shaped recess and into which the linear part of the engaging projection 27*a* is to be fitted. The cylindrical main portion 281 includes a through hole 284 perforated along its rotation axis A. The cylindrical recess communicates with the through hole 284.

The rotary member 29 includes an annular gear portion 291 and a cylindrical supporting portion 292 extending from the gear portion 291 in the direction D2. A rack member 32 to be described later is meshed with the gear portion 291. The cylindrical supporting portion 292 supports the joint member 28 movably forward and backward in the advancing direction (direction D1) and the retracting direction (direction D2) between an advanced position and a retracted position and rotatably about the rotation axis A with the cylindrical main portion 281 of the joint member 28 inserted therein.

The cylindrical supporting portion 292 includes a pair of recesses 293 indented in the direction D1 and spirally inclined portions 294 inclined in the direction D2 with respect to a circumferential direction of the cylindrical supporting portion 292 from the respective recesses 293 and spirally extending from the recesses 293 in a rotating direction D4. The pair of recesses 293 are formed at positions facing each other in a radial direction of the cylindrical supporting portion 292. As described later, the respective projections 283 are engaged with the corresponding recesses 293 when the joint member 28 is at the advanced position. The respective projections 283 move relative to the respective spiral inclined surfaces 294 while being held in contact with the respective spiral inclined surfaces 294 when the joint member 28 moves forward and backward.

The frame member 41 includes an annular frame body 411 forming an accommodation space for rotatably accommodating the rotary member 29, a pair of extending portions 414 extending in the direction D2 from a peripheral edge portion of the frame body 411 in the direction D2, an arched linking portion 416 linking ends of these extending portions 414 in the direction D2, a column 412 extending in the direction D1 along the rotation axis A from the linking portion 416, four leg portions 417*a* to 417*d* extending in the direction D1 from a peripheral edge portion of the frame body 411 in the direction D1 and held in contact with the side plate 100*c* of the image forming apparatus main body 100, and a pair of engaging pieces 413 extending in the direction D1 from the frame body 411 to fix the frame body 411 to the side plate 100*c* of the image forming apparatus main body 100.

The column 412 is inserted into the through hole 284 of the joint member 28. The engaging pieces 413 are respectively fitted into engaging holes 100*d* formed in the side plate 100*c* of the image forming apparatus main body 100 as shown in FIG. 2.

Each extending portion 414 includes a rotation preventing surface 414*a* at a side in the rotating direction D4. The rotation preventing surfaces 414*a* are for preventing a rotation of the joint member 28 in a rotating direction D3 by being held in contact with the projections 283 as described later. The rotation preventing surfaces 414*a* are formed substantially parallel to the rotation axis A.

The frame member 41 also includes a pair of inclined surfaces 415 formed along an inner side surface of the frame body 411. The respective inclined surfaces 415 are inclined in the direction D2 with respect to the circumferential direction of the cylindrical supporting portion 292 of the rotary member 29, extend in the rotating direction D3, and are connected to ends of the rotation preventing surfaces 414*a* in the direction D1. The respective inclined surfaces 415 are located between the inner side surface of the frame body 411 and the outer side surface of the cylindrical supporting portion 292 of the rotary member 29.

A spring 30 as a biasing member for biasing the joint member 28 in the direction D1 (advancing direction) is arranged between the end of the joint member 28 in the direction D2 and the linking portion 416 of the frame member 41. The column 412 is inserted into the interior of the spring 30.

Next, there is described a mechanism (linking mechanism) for opening and closing the toner supply ports 25 of the respective toner containers 12*a* to 12*d* as the top cover 100*a* is closed and opened.

Figure 6:
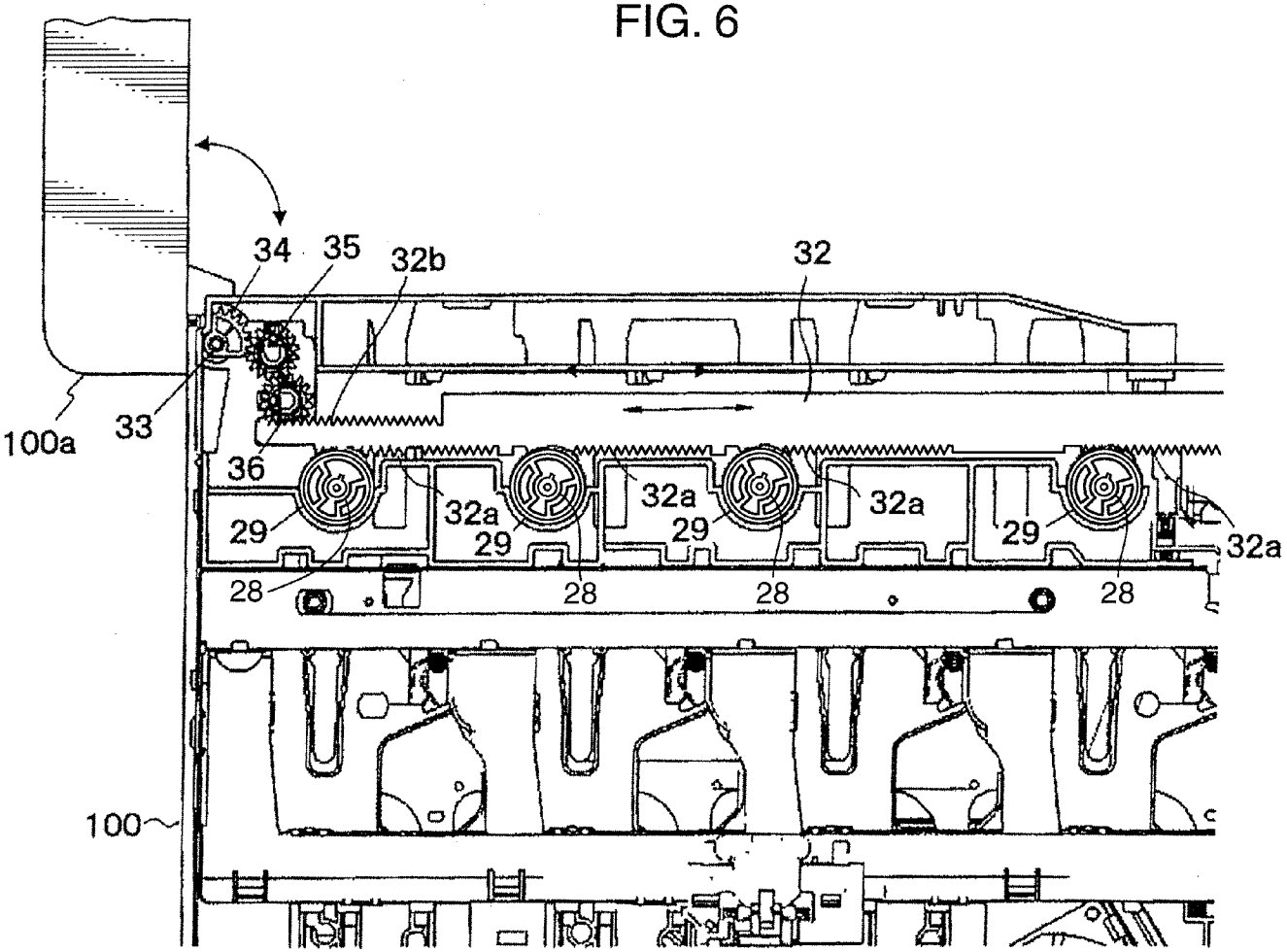
FIG. 6 is a diagram showing a linking mechanism for linking opening and closing movements of a top cover and movements of the shutter opening/closing mechanism.

As shown in FIG. 6, the rack member 32 is arranged movably in horizontal directions (arrow directions) in an upper part of the image forming apparatus main body 100. The rack member 32 includes four racks 32*a* formed on its lower surface. The rotary members 29 corresponding to the respective toner containers 12*a* to 12*d* are respectively meshed with the corresponding racks 32*a*.

A fan-shaped sector gear 34 is fixed to a pivot shaft 33 of the top cover 100*a*. The sector gear 34 is engaged with a pinion gear 36 via an idle gear 35. The pinion gear 36 is meshed with a rack 32*b* formed on the upper surface of one longitudinal end of the rack member 32.

When the top cover 100*a* is rotated about the pivot shaft 33 to be opened and closed, the rack member 32 reciprocates in the horizontal directions, whereby the rotary members 29 respectively meshed with the four racks 32*a* formed on the rack member 32 rotate.

Figure 7A:
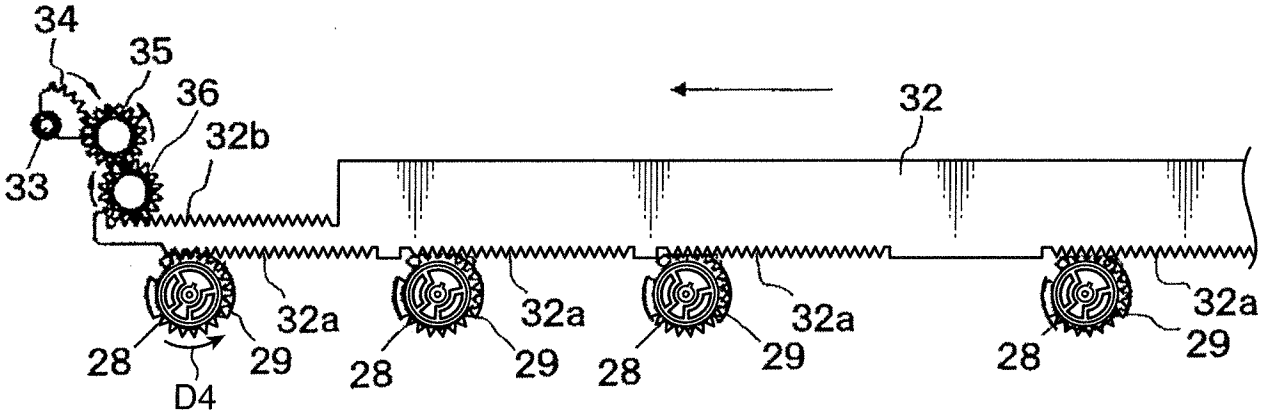
FIG. 7A is a diagram showing a state of an engaging portion of a joint member in an open state of the top cover.

When the top cover 100*a* is moved in a closing direction from a fully open state (open state), the pivot shaft 33 and the sector gear 34 fixed to the pivot shaft 33 rotate in arrow direction of FIG. 7A and this rotation is transmitted to the pinion gear 36 via the idle gear 35 as shown in FIG. 7A. When the pinion gear 36 rotates in an arrow direction, the rack member 32 moves in an arrow direction. When the rack member 32 moves in the arrow direction, the four rotary members 29 meshed with the racks 32*a* of the rack member 32 rotate in arrow directions (rotating directions D4).

Figure 7B:
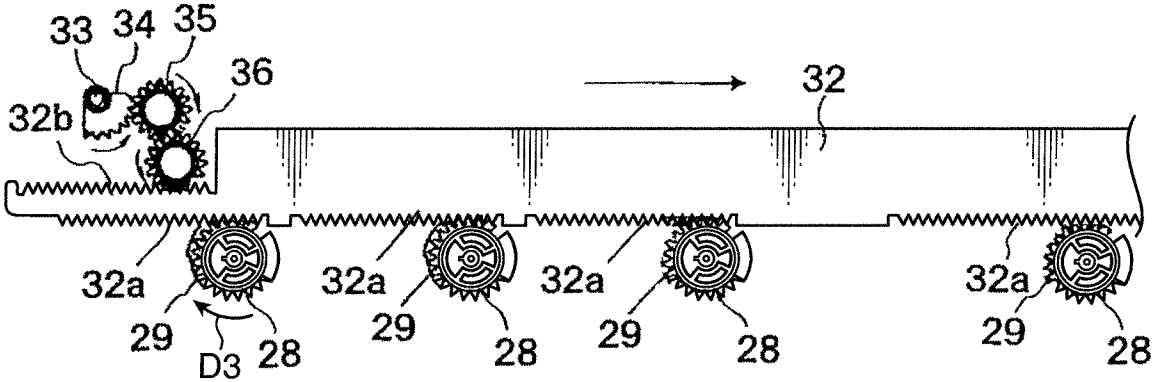
FIG. 7B is a diagram showing a state of the engaging portion of the joint member in a closed state of the top cover.
Figure 8A:
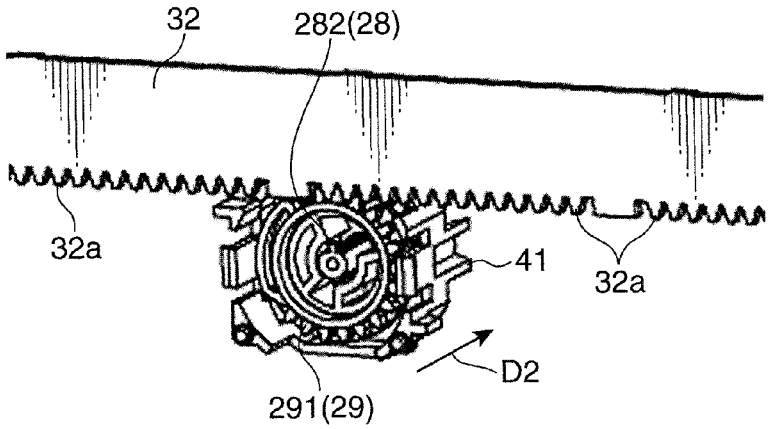
FIGS. 8A to 8C are perspective views showing movements of the shutter opening/closing mechanism.
Figure 8B:
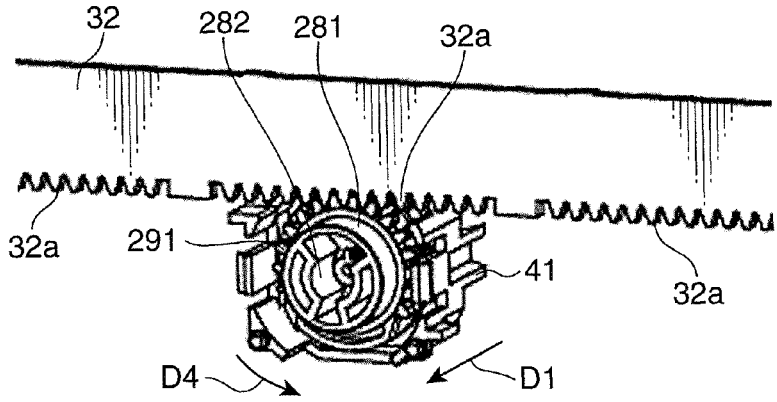
Figure 8C:
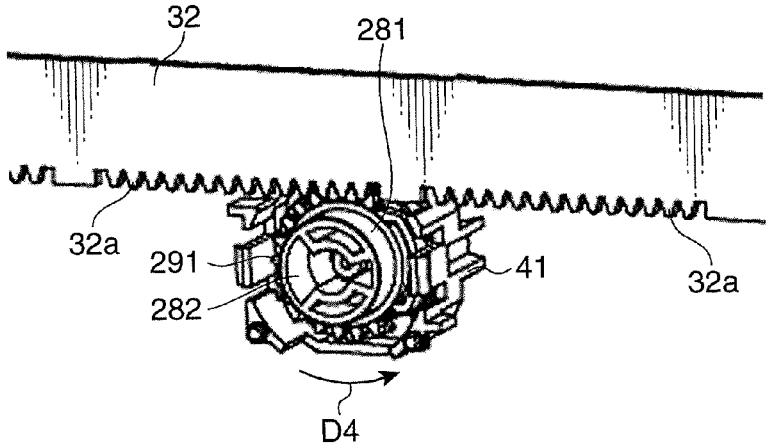
Figures 9A, 9B, 9C:
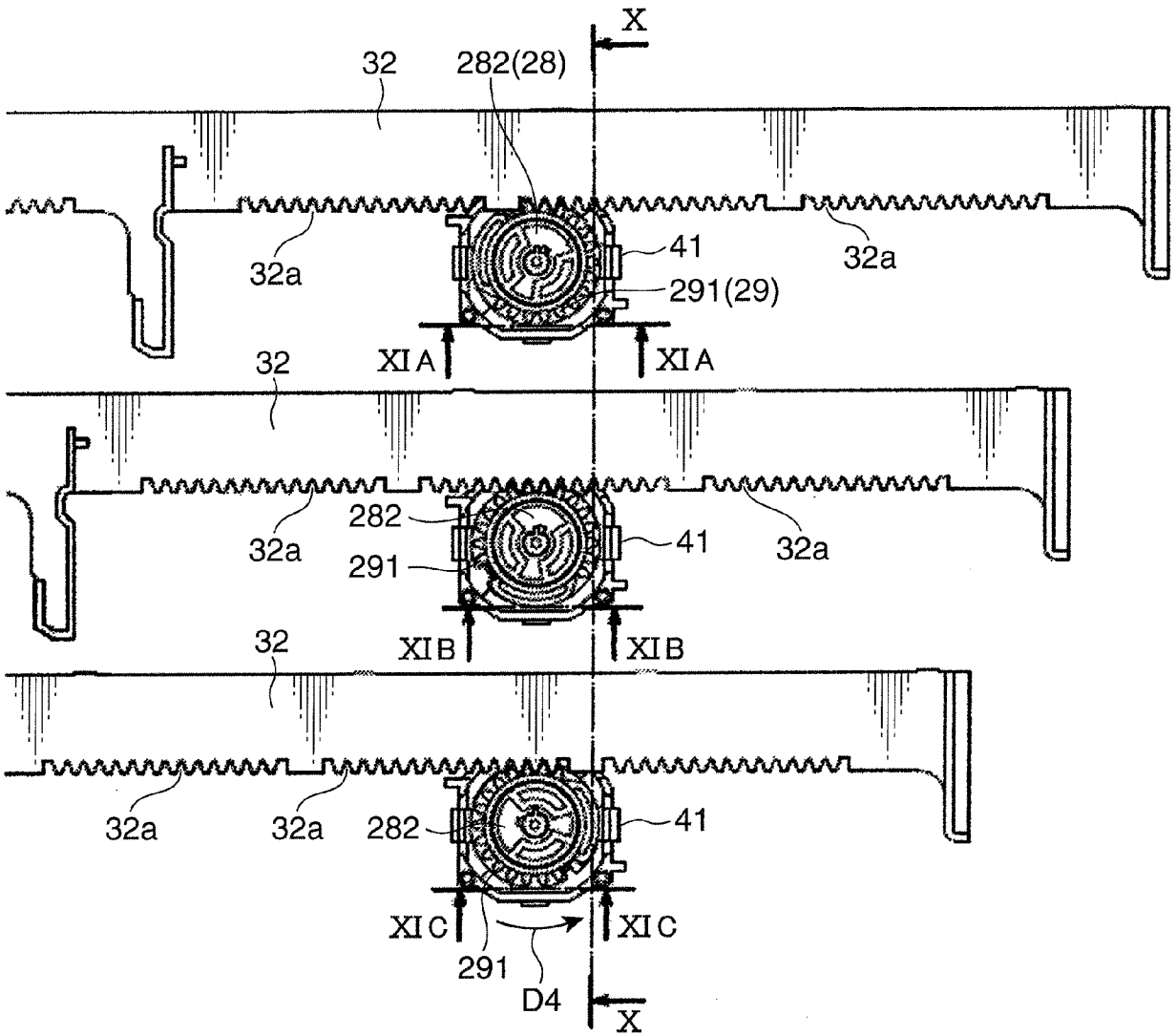
FIGS. 9A to 9C are front views showing movements of the shutter opening/closing mechanism.

On the other hand, when the top cover 100*a* is moved in an opening direction from a fully closed state (closed state), the pivot shaft 33 and the sector gear 34 fixed to the pivot shaft 33 rotate in arrow direction of FIG. 7B and this rotation is transmitted to the pinion gear 36 via the idle gear 35 as shown in FIG. 7B. When the pinion gear 36 rotates in an arrow direction, the rack member 32 moves in an arrow direction. When the rack member 32 moves in the arrow direction, the four rotary members 29 meshed with the racks 32*a* of the rack member 32 rotate in arrow directions (rotating directions D3).

In the shutter closing/opening member of this embodiment, the toner supply ports 25 of the toner containers 12 can be opened and closed as the top cover 100*a* is closed and opened between the open state and the closed state. In addition, the coupling members 27 and the joint members 28 can be connected and separated each other as the top cover 100*a* is closed and opened. These movements are described in detail below. Since the toner containers 12*a* to 12*d* have the same basic construction, the shutter opening/closing mechanism in the magenta toner container 12*a* is described as a representative example.

FIGS. 8 to 12 are views showing movements of the shutter closing/opening member according to this embodiment. FIGS. 10A to 10C are sectional views along X-X of FIGS. 9A to 9C. FIG. 11A is a sectional view along XIA-XIA of FIG. 9A, FIG. 11B is a sectional view along XIB-XIB of FIG. 9B, and FIG. 11C is a sectional view along XIC-XIC of FIG. 9C.

FIGS. 8A, 9A, 10A and 11A show an arrangement of the joint member 28 when the top cover 100*a* is in the "open state". FIGS. 8B, 9B, 10B and 11B show an arrangement of the joint member 28 when the top cover 100*a* is in a "half open state". FIGS. 8C, 9C, 10C and 11C show an arrangement of the joint member 28 when the top cover 100*a* is in the "closed state".

Figure 12A:
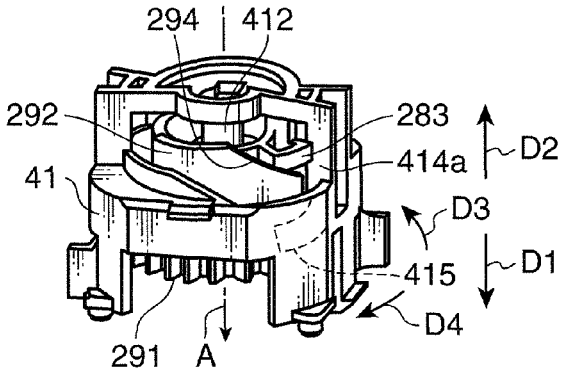
FIGS. 12A to 12E are perspective views showing movements of the shutter opening/closing mechanism.

FIGS. 12A to 12E are perspective views showing movements of the shutter closing/opening member in a fragmented manner. FIG. 13 is a sectional view along XIII-XIII of FIG. 12C.

Note that the "open state" means the fully open state of the top cover 100*a* and the "closed state" means the fully closed state of the top cover 100*a*. Further, the "half open state" means a state of the top cover 100*a* between the open state and the closed state when a rotational movement of the joint member 28 and a forward/backward movement thereof to be described later are switched. Thus, the "half open state" does not necessarily mean that the top cover 100*a* is at a middle position (½ position) between the open state and the closed state.

First of all, an operation of inserting the toner container 12 to predetermined position in the image forming apparatus main body 100 is described. Upon inserting the toner container 12 to the predetermined position, the top cover 100*a* is opened to the open state. In the open state, the joint member 28 is at a position shown in FIGS. 8A, 9A, 10A and 11A. At this time, the joint member 28 is at a retracted position attained by moving in the direction D2.

When being at the retracted position, the joint member 28 does not project in the direction D1 from the surface of the aforementioned guide groove 100*b* of the side plate 100*c* and accommodated in the rotary member 29. Accordingly, the coupling member 27 can be smoothly moved to the bottom end of the guide groove 100*b* along the guide groove 100*b*, whereby each toner container 12 can be smoothly inserted to the predetermined position. When each toner container 12 is inserted to the predetermined position, each joint member 28 is arranged to face the coupling member 27 of the toner container 12.

When each toner container 12 is inserted to the predetermined position, a user closes the top cover 100*a*. When the top cover 100*a* is closed from the open state to the half open state, the rack member 32 moves to rotate each rotary member 29 in the direction D4 and each joint member 28 moves to a position shown in FIGS. 8B, 9B, 10B and 11B. In other words, the joint member 28 moves in the direction D1 from the retracted position to be arranged at an advanced position. When the joint member 28 moves to the advanced position, the engaging recess 282 of the joint member 28 is engaged with the engaging projection 27*a* of the coupling member 27.

Figure 10A:
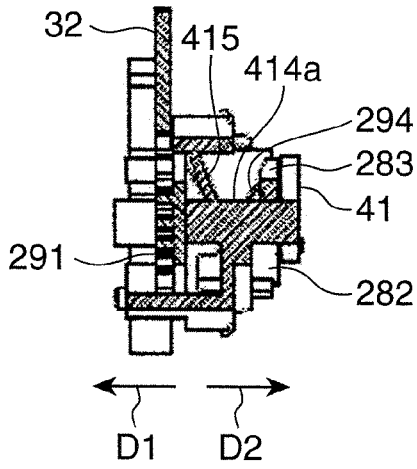
FIGS. 10A to 10C are sectional views along X-X of FIGS. 9A to 9C.
Figure 10B:
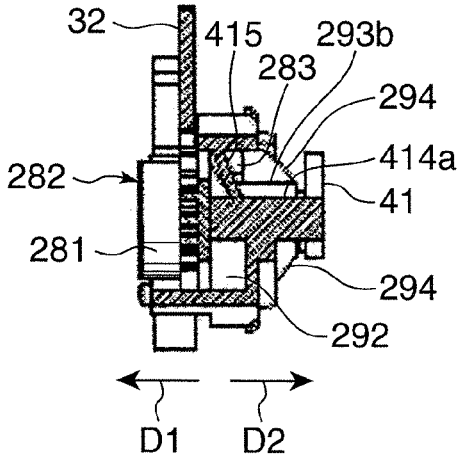
Figure 10C:
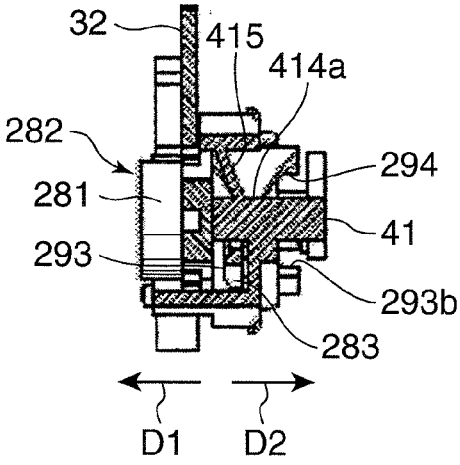
Figure 11A:
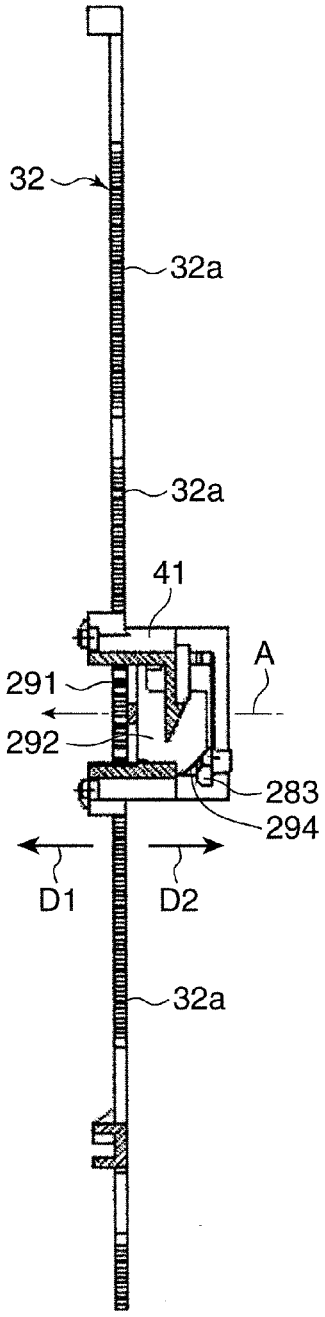
FIG. 11A is a sectional view along XIA-XIA of FIG. 9A.
Figure 11B:
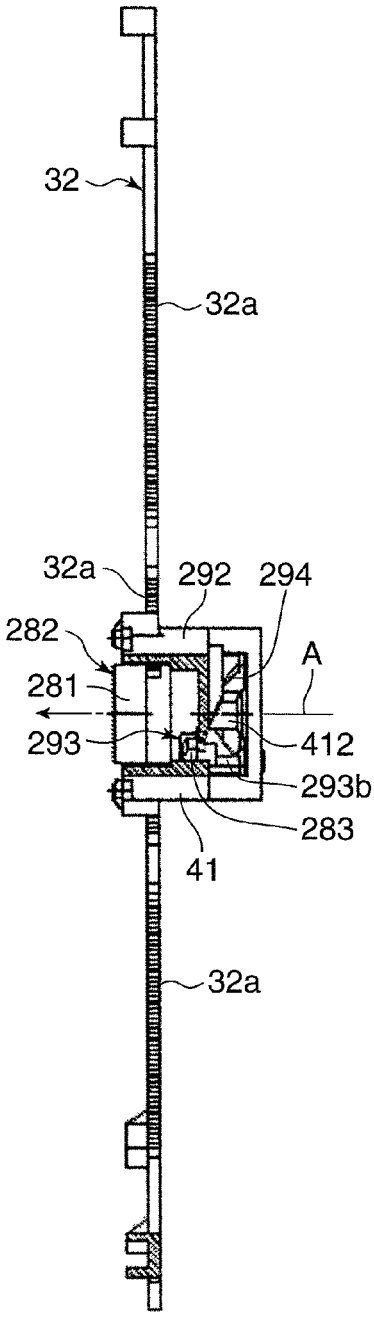
FIG. 11B is a sectional view along XIB-XIB of FIG. 9B
Figure 11C:
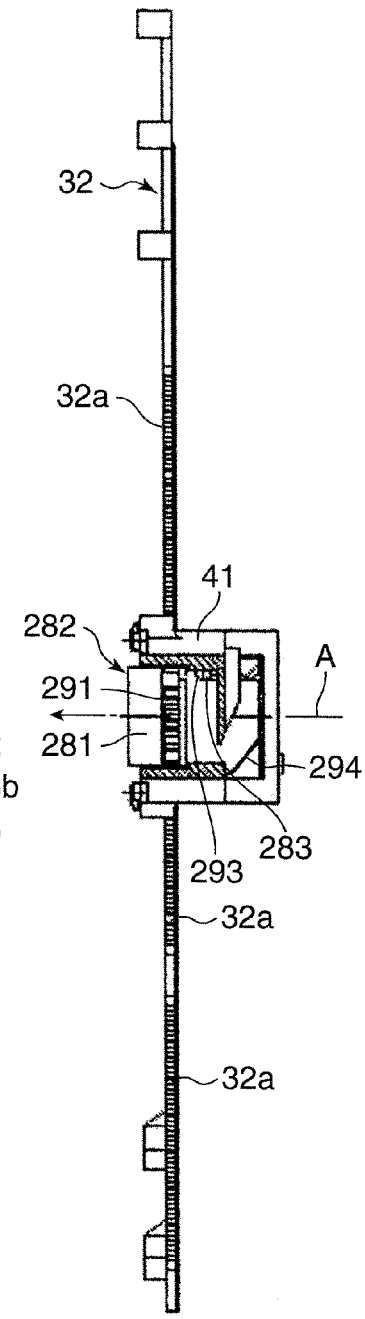
FIG. 11C is a sectional view along XIC-XIC of FIG. 9C.

This advancing movement of the joint member 28 is described in more detail below. First of all, when the top cover 100*a* is in the open state, the joint member 28 is located at the retracted position with lateral parts of the projections 283 held in contact with parts of the rotation preventing surfaces 414*a* of the extending portions 414 of the frame member 41 in the direction D2 and the lower surfaces of the projections 283 held in contact with parts of the spiral inclined portions 294 of the rotary member 29 in the direction D2 as shown in FIGS. 10A, 11A and 12A.

Figure 12B:
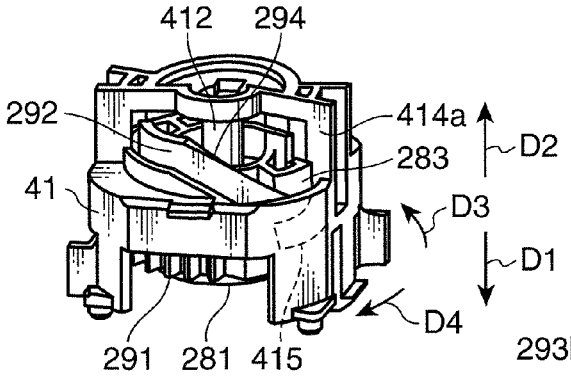
Figure 13:
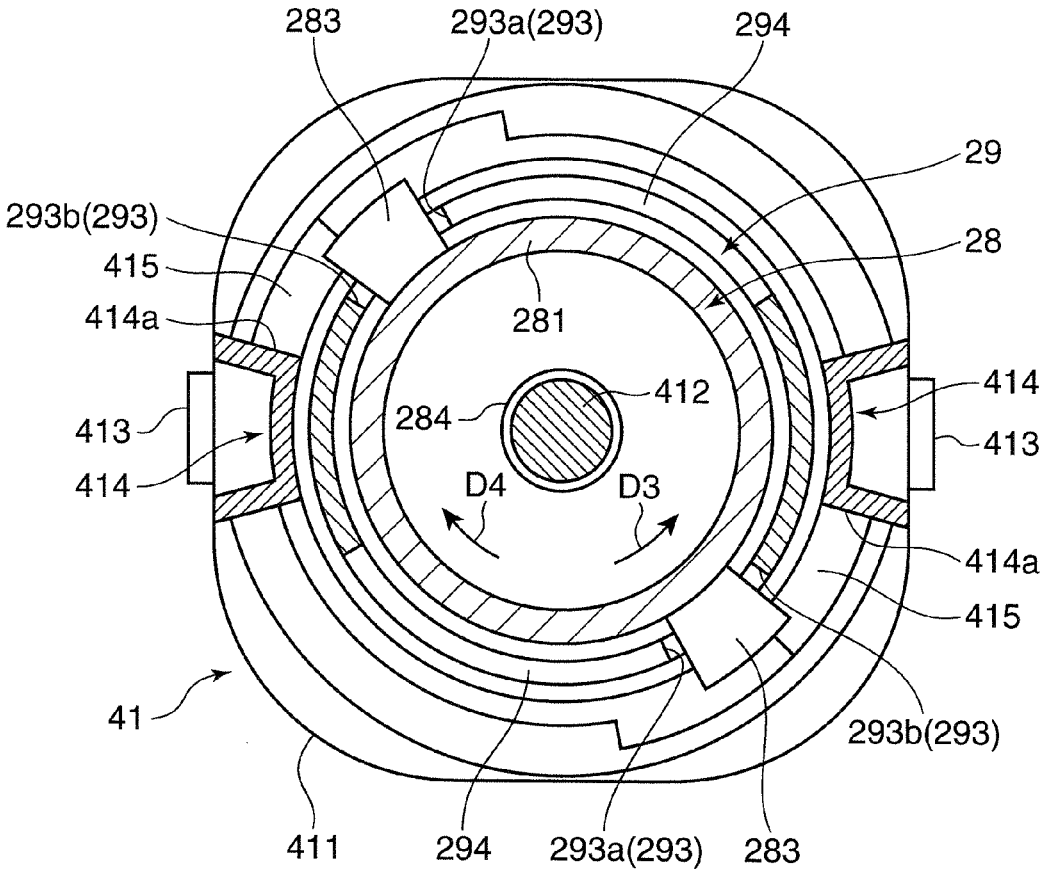
FIG. 13 is a sectional view along XIII-XIII of FIG. 12C.

As the top cover 100*a* is closed in the closing direction from the open state, the spiral inclined surfaces 294 of the rotary member 29 move in the rotating direction D4 as shown in FIG. 12B, wherefore positions where the spiral inclined surfaces 294 support the projections 283 move in the direction D1. At this time, since the joint member 28 is biased in the direction D1 (advancing direction) by the spring 30, the projections 283 move in the direction D1 along the rotation preventing surfaces 414*a* while sliding on the spiral inclined surfaces 294. In this way, the joint member 28 moves in the direction D1 from the retracted position.

As the top cover 100*a* is further closed in the closing direction, the projections 283 further move in the direction D1 along the rotation preventing surfaces 414*a* while sliding on the spiral inclined surfaces 294 and reach ends of the rotation preventing surfaces 414*a* in the direction D1. When passing the ends of the rotation preventing surfaces 414*a* in the direction D1, the projections 283 start sliding on the inclined surfaces 415 continuous with these ends.

At a point of time when the top cover 100*a* reaches the half open state, the projections 283 are at positions facing the recesses 293 and near ends of the inclined surfaces 415 in the direction D4 as shown in FIGS. 10B, 11B, 12C and 13 after passing the ends of the spiral inclined surfaces 294 in the direction D3.

At this time, the projections 283 are held in contact with the inclined surfaces 415 and the recesses 293. Specifically, as shown in FIG. 5A, each projection 283 includes beveled portions 283*a*, 283*a* formed by beveling both corners at a side in the direction D1, and a central part 283*b* located between these beveled portions 283*a*. Respective angles of inclination of these beveled portions 283*a* are designed to be substantially equal to respective angles of inclination of the inclined surfaces 415. Out of the beveled portions 283*a*, the one in the direction D3 is held in contact with the inclined surface 415. The respective central parts 283*b* are held in contact with the respective recesses 293.

At this point of time, the joint member 28 is located at the advanced position and the engaging recess 282 is engaged with the engaging projection 27*a* of the coupling member 27. At this point of time, the joint member 28 ends its advancing movement and proceeds to its rotational movement.

The rotational movement of the joint member 28 is as follows. As the top cover 100*a* is further closed in the closing direction from the half open state, the rotary member 29 rotates in the direction D4. By this rotation of the rotary member 29, side walls 293*b* of the recesses 293 of the rotary member 29 come into contact with the projections 283 of the joint member 28 to push the projections 283 in the direction D4, wherefore the projections 283 pass the ends of the inclined surfaces 415 of the frame members 41 in the direction D4, are released from the supported state by the inclined surfaces 415 and fitted into (engaged with) the recesses 293. Since the inclined surfaces 415 function as guiding surfaces when the projections 283 are engaged with the recesses 293 in this embodiment, transition from the advancing movement of the joint member 28 to the rotational movement thereof becomes smoother.

Figure 12C:
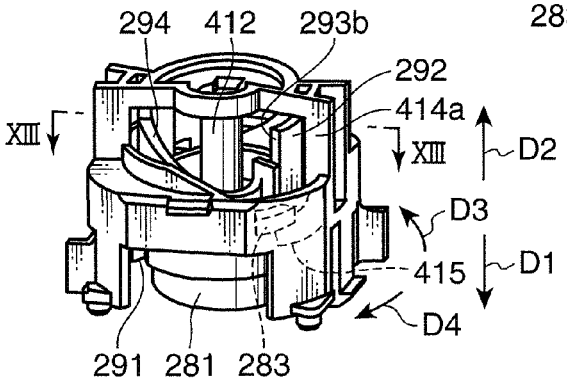
Figure 12D:
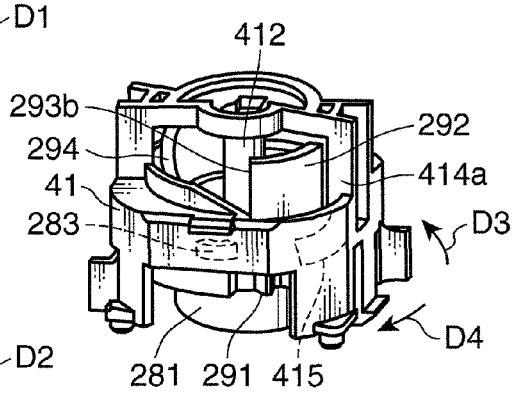
Figure 12E:
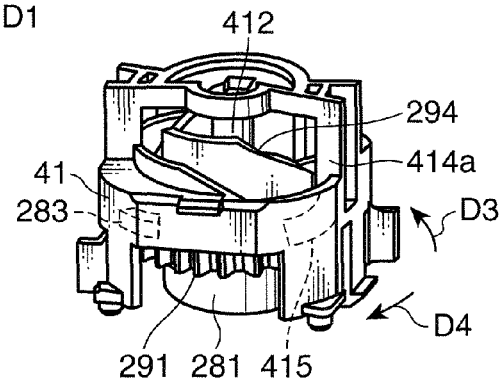

When the top cover 100*a* is further closed in the closing direction, the rotary member 29 rotates in the direction D4, wherefore the projections 283 engaged with the recesses 293 are pushed in the direction D4 by the recesses 293 and the joint member 28 rotates in the direction D4 (FIG. 12D). When the top cover 100*a* is further closed, the projections 283 engaged with the recesses 293 are pushed in the direction D4 and the joint member 28 further rotates in the direction D4. When the top cover 100*a* reaches the closed state, the joint member 28 reaches a position shown in FIGS. 8C, 9C, 10C, 11C and 12E. By this time, the engaging recess 282 of the joint member 28 has rotated to a position shown in FIGS. 8C and 9C. According to this rotation of the joint member 28, the coupling member 27 engaged with the engaging recess 282 also rotates in the same direction. In this way, the container shutter 26 rotates to open the toner supply port 25 (FIG. 4B). By the above, the opening movement of the container shutter 26 is completed.

Next, an operation of detaching the toner container 12 from the predetermined position of the image forming apparatus main body 100 is described. First of all, when the top cover 100*a* is opened in the opening direction from the closed state, the rack member 32 moves to rotate the rotary member 29 in the direction D3. According to this rotation of the rotary member 29, the recesses 293 of the rotary member 29 push the projections 283 of the joint member 28 in the direction D3, wherefore the joint member 28 rotates in the direction D3 to move from the position shown in FIG. 12E to a position shown in FIG. 12D.

When the top cover 100*a* is further opened to reach the half open state, the joint member 28 further rotates in the direction D3 and moves to a position shown in FIG. 12C. At this time, the beveled portions 283*a* of the projections 283 are held in contact with the inclined surfaces 415 and the central parts 283*b* of the projections 283 are held in contact with the recesses 293. At this point of time, the joint member 28 ends its rotational movement to transition to its retracting movement.

Further, when the top cover 100*a* is opened from the closed state to the half open state, the joint member 28 rotates in the rotating direction D3 at the advanced position to rotate the coupling member 27 in a direction for closing the toner supply port 25 (move the coupling member 27 from the state shown in FIG. 4B to the state shown in FIG. 4A).

When the top cover 100*a* is further opened in the opening direction from the half open state, the projections 283 are pushed by the recesses 293 to rotate in the direction D3 as the rotary member 29 rotates in the direction D3. When rotating in the direction D3 in the state of FIG. 12C, the projections 283 start sliding on the inclined surfaces 415 to move away from the recesses 293. That is, the projections 283 are disengaged from the recesses 293 upon approaching the rotation preventing surfaces 414*a* and move onto the spiral inclined portions 294 of the rotary member 29.

In other words, when moving onto the spiral inclined portions 294 from the state engaged with the recesses 293, the projections 283 are pushed by one side walls 293*a* of the recesses 293 and slide along the inclined surfaces 415 of the frame member 41 while rotating in the rotating direction D3, thereby moving in the direction D2 (retracting direction) along the one side walls 293*a* of the recesses 293. In this way, the projections 283 are disengaged from the recesses 293.

When the top cover 100*a* is further opened in the opening direction, the projections 283 come into contact with the rotation preventing surfaces 414*a* of the frame member 41 as shown in FIG. 12B to have their rotations in the rotating directions D3 prevented, and are pushed by the spiral inclined portions 294 rotating in the rotating direction D3, thereby sliding on the rotation preventing surfaces 414*a* in the direction D2 (retracting direction) while sliding on the spiral inclined portions 294. When the top cover 100*a* reaches the open state, the joint member 28 reaches the retracted position shown in FIG. 12A to end its retracting movement. At this time, the coupling member 27 is disengaged from the joint member 28. In addition, when being at the retracted position, the joint member 28 does not project into the aforementioned guide groove 100*b* of the side plate 100*c* and is accommodated in the rotary member 29, wherefore the toner container 12 can be smoothly taken out upward from the predetermined position.

In this embodiment, the joint member can rotate according to the rotation of the rotary member when the cover is opened and closed between the closed state and the half open state. In addition, the joint member can move forward and backward between the advanced position and the retracted position according to the rotation of the rotary member when the cover is opened and closed between the open state and the half open state. In this way, the coupling member can be engaged with the joint member and disengaged from the joint member as the cover is closed and opened. Thus, resistance at the time of inserting the toner container to the predetermined position of the image forming apparatus main body is eliminated or reduced unlike the prior art and it becomes unnecessary to rotate the toner container and obliquely pull it out at the time of detaching the toner container from the image forming apparatus main body. Therefore, the toner container can be smoothly mounted into and detached from the image forming apparatus main body.

Further, in this construction, upon detaching the toner container from the image forming apparatus main body, the coupling member is disengaged from the joint member by opening the cover from the half open state to the open state after the toner supply port is closed by opening the cover from the closed state to the half open state. Accordingly, there is no likelihood of detaching the toner container with the toner supply port of the toner container left open. Further, upon mounting the toner container into the image forming apparatus main body, the toner supply port of the toner container is opened by closing the cover from the half open state to the closed state after the coupling member is engaged with the joint member by closing the cover from the open state to the half open state. Thus, there is no likelihood of opening the toner supply port during the insertion of the toner container. Therefore, it is possible to suppress such inconvenience that the toner scatters around from the toner supply port of the toner container while the toner container is mounted and detached.

The present invention is not limited to the above embodiment and various changes, modifications and the like can be made without departing from the scope thereof. For example, although the present invention is applied to the full color laser beam printer in the above embodiment, it is similarly applicable to other image forming apparatuses such as color printers and color complex machines.

This application is based on Japanese Patent Application Serial No. 2010-017722 filed in the Japan Patent Office on Jan. 29, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A shutter opening/closing mechanism for opening and closing a toner supply port of a toner container as a cover of an image forming apparatus main body is moved between a closed state and an opened state, comprising:

a rotary member provided in the image forming apparatus main body and rotates in one rotating direction as the cover is opened while rotating in another rotating direction as the cover is closed;

a joint member that is moved forward in an advancing direction between a retracted position and an advanced position along a direction of a rotation axis of the joint member in response to a rotation of the rotary member caused by movement of the cover between the opened state and a half open state or backward in a retracting direction between the advanced position and the retracted position in response to the rotation of the rotary member caused by movement of the cover between the half opened state and the opened state, and the joint member being rotatable at the advanced position in response to a rotation of the rotary member caused by movement of the cover between the half open state and the closed state; and a coupling member rotatably provided in the toner container, the coupling member being engaged with the joint member when the joint member is at the advanced position while being disengaged from the joint member when the joint member is at the retracted position, the coupling member opening and closing the toner supply port by rotating in response to the rotation of the joint member engaged therewith at the advanced position.

2. A shutter opening/closing mechanism according to claim 1, further comprising a frame member which is fixed to the image forming apparatus main body and supports the rotary member and the joint member while accommodating the rotary member and the joint member inside, wherein:

the joint member includes a cylindrical main portion, an engaging portion provided at an end of the cylindrical main portion in the advancing direction and engageable with the coupling member, and a projection projecting radially outward from the cylindrical main portion;

the rotary member includes a cylindrical supporting portion which supports the joint member movably forward and backward and rotatably with the cylindrical main portion inserted therein, the cylindrical supporting portion includes a recess engaged with the projection when the joint member is at the advanced position, and a spiral inclined portion which is inclined in the retracting direction with respect to a circumferential direction of the cylindrical supporting portion and spirally extends in the other rotating direction from the recess and on which the projection is relatively movable while being held in contact;

the frame member includes a rotation preventing surface extending in the retracting direction to prevent a rotation of the joint member in the one rotating direction by being held in contact with the projection;

the projection is pushed by one side wall of the recess of the rotary member rotating in the one rotating direction when the cover is opened from the closed state to the half open state, whereby the joint member rotates in the one rotating direction at the advanced position to rotate the coupling member in a direction for closing the toner supply port; and the projection comes into contact with the rotation preventing surface to have its rotation in the one rotating direction prevented and is pushed by the spiral inclined portion of the rotary member rotating in the one rotating direction when the cover is opened from the half open state to the open state, thereby sliding in the retracting direction on the rotation preventing surface while sliding on the spiral inclined portion to move the joint member from the advanced position to the retracted position.

3. A shutter opening/closing mechanism according to claim 2, wherein:

the frame member further includes an inclined surface inclined in the retracting direction with respect to the circumferential direction, extending in the one rotating direction, and connected to an end of the rotation preventing surface in the advancing direction, and the projection is pushed by the one side wall of the recess to slide along the inclined surface while rotating in the one rotating direction when moving onto the spiral inclined portion from a state engaged with the recess, thereby moving in the retracting direction along the one side wall of the recess to be disengaged from the recess.

4. A shutter opening/closing mechanism according to claim 2, further comprising a biasing member for biasing the joint member in the advancing direction, wherein:

the spiral inclined portion of the rotary member rotating in the other rotating direction moves in the other rotating direction and the joint member is pushed in the advancing direction by the biasing member when the cover is closed from the open state to the half open state, whereby the projection slides in the advancing direction on the rotation preventing surface while sliding on the spiral inclined portion, thereby moving the joint member from the retracted position to the advanced position to engage the engaging portion with the coupling member; and the projection is pushed by an other side wall of the recess of the rotary member rotating in the other rotating direction when the cover is closed from the half open state to the closed state, whereby the joint member rotates in the other rotating direction at the advanced position to rotate the coupling member in a direction for opening the toner supply port.

5. An image forming apparatus, comprising:

an image forming apparatus main body including a cover that is movable between an opened state and a closed state;

a toner container including an openable and closable toner supply port and detachably mountable into the image forming apparatus main body; and a shutter opening/closing mechanism for opening and closing the toner supply port as the cover is moved between the closed state and the opened state, wherein the shutter opening/closing mechanism includes:

a rotary member provided in the image forming apparatus main body and rotates in one rotating direction as the cover is opened while rotating in another rotating direction as the cover is closed;

a joint member that is moved forward in an advancing direction between a retracted position and an advanced position along a direction of a rotation axis of the joint member in response to a rotation of the rotary member caused by a movement of the cover between the open state and a half open state or backward in a retracting direction between the advanced position and the retracted position in response to the rotation of the rotary member caused by movement of the cover between the half open state and the open state, and the joint member being rotatable at the advanced position in response to a rotation of the rotary member caused by movement of the cover between the half open state and the closed state; and a coupling member rotatably provided in the toner container, the coupling member being engaged with the joint member when the joint member is at the advanced position while being disengaged from the joint member when the joint member is at the retracted position, the coupling member opening and closing the toner supply port by rotating in response to the rotation of the joint member engaged therewith at the advanced position.

6. An image forming apparatus according to claim 5, further comprising a frame member which is fixed to the image forming apparatus main body and supports the rotary member and the joint member while accommodating the rotary member and the joint member inside, wherein:

the joint member includes a cylindrical main portion, an engaging portion provided at an end of the cylindrical main portion in the advancing direction and engageable with the coupling member, and a projection projecting radially outward from the cylindrical main portion;

the rotary member includes a cylindrical supporting portion which supports the joint member movably forward and backward and rotatably with the cylindrical main portion inserted therein, the cylindrical supporting portion includes a recess engaged with the projection when the joint member is at the advanced position, and a spiral inclined portion which is inclined in the retracting direction with respect to a circumferential direction of the cylindrical supporting portion and spirally extends in the other rotating direction from the recess and on which the projection is relatively movable while being held in contact;

the frame member includes a rotation preventing surface extending in the retracting direction to prevent a rotation of the joint member in the one rotating direction by being held in contact with the projection;

the projection is pushed by one side wall of the recess of the rotary member rotating in the one rotating direction when the cover is opened from the closed state to the half open state, whereby the joint member rotates in the one rotating direction at the advanced position to rotate the coupling member in a direction for closing the toner supply port; and the projection comes into contact with the rotation preventing surface to have its rotation in the one rotating direction prevented and is pushed by the spiral inclined portion of the rotary member rotating in the one rotating direction when the cover is opened from the half open state to the open state, thereby sliding in the retracting direction on the rotation preventing surface while sliding on the spiral inclined portion to move the joint member from the advanced position to the retracted position.

7. An image forming apparatus according to claim 6, wherein:

the frame member further includes an inclined surface inclined in the retracting direction with respect to the circumferential direction, extending in the one rotating direction, and connected to an end of the rotation preventing surface in the advancing direction, and the projection is pushed by the one side wall of the recess to slide along the inclined surface while rotating in the one rotating direction when moving onto the spiral inclined portion from a state engaged with the recess, thereby moving in the retracting direction along the one side wall of the recess to be disengaged from the recess.

8. An image forming apparatus according to claim 6, further comprising a biasing member for biasing the joint member in the advancing direction, wherein:

the spiral inclined portion of the rotary member rotating in the other rotating direction moves in the other rotating direction and the joint member is pushed in the advancing direction by the biasing member when the cover is closed from the open state to the half open state, whereby the projection slides in the advancing direction on the rotation preventing surface while sliding on the spiral inclined portion, thereby moving the joint member from the retracted position to the advanced position to engage the engaging portion with the coupling member; and the projection is pushed by an other side wall of the recess of the rotary member rotating in the other rotating direction when the cover is closed from the half open state to the closed state, whereby the joint member rotates in the other rotating direction at the advanced position to rotate the coupling member in a direction for opening the toner supply port.

9. A shutter opening/closing mechanism according to claim 1, wherein:

the joint member includes a cylindrical main portion and at least one projection projecting radially out from the cylindrical main portion;

the rotary member includes a cylindrical supporting portion that supports the joint member movably forward and backward and rotatably with the cylindrical main portion inserted therein;

the cylindrical supporting portion includes a spiral inclined portion that is inclined in the retracting direction with respect to a circumferential direction of the cylindrical supporting portion and spirally extends in the other rotating direction, the projection being relatively movable along the spiral inclined surface while being held in contact therewith;

the projection is pushed by the spiral inclined portion of the rotary member and rotating in the one rotating direction as the cover is opened from the half open state to the open state, to thereby move the joint member from the advanced position to the retracted position.

10. An image forming apparatus according to claim 5, wherein:

the joint member includes a cylindrical main portion and at least one projection projecting radially out from the cylindrical main portion;

the rotary member includes a cylindrical supporting portion that supports the joint member movably forward and backward and rotatably with the cylindrical main portion inserted therein;

the cylindrical supporting portion includes a spiral inclined portion that is inclined in the retracting direction with respect to a circumferential direction of the cylindrical supporting portion and spirally extends in the other rotating direction, the projection being relatively movable along the spiral inclined portion while being held in contact therewith;

the projection is pushed by the spiral inclined portion of the rotary member and rotating in the one rotating direction as the cover is opened from the half open state to the open state, to thereby move the joint member from the advanced position to the retracted position.

* * * * *